United States Patent [19]

Hodge et al.

[11] Patent Number: 5,074,889

[45] Date of Patent: Dec. 24, 1991

[54] AROMATIC POLYAMIDE FIBERS AND METHOD OF PRINTING SUCH FIBERS WITH ACID DYES IN THE PRESENCE OF HEXAMETHYLENE DIAMINE DIHYDROCHLORIDE IMPREGNATED IN FIBER

[75] Inventors: James D. Hodge, Midlothian; Elizabeth A. Dodgson, Chesterfield; David J. Rodini, Midlothian, all of Va.

[73] Assignee: E. I. Du Pont de Nemours and Company, Wilmington, Del.

[21] Appl. No.: 538,061

[22] Filed: Jun. 13, 1990

[51] Int. Cl.[5] ..... C09B 67/00

[52] U.S. Cl. ..... 8/602; 8/475; 8/476; 8/538; 8/680; 8/900; 8/925

[58] Field of Search ..... 8/475, 476, 602, 680

[56] References Cited

U.S. PATENT DOCUMENTS

| | | | |
|---|---|---|---|
| 3,287,324 | 11/1966 | Sweeny | 528/348 |
| 3,558,267 | 1/1971 | Langenfeld | 8/586 |
| 4,525,168 | 6/1985 | Kelly | 8/130.1 |
| 4,710,200 | 12/1987 | Cates et al. | 8/574 |
| 4,755,335 | 7/1988 | Ghorashi | 264/48 |
| 4,883,496 | 11/1989 | Ghorashi | 8/476 |
| 4,919,869 | 4/1990 | Zatkulak et al. | 264/78 |

FOREIGN PATENT DOCUMENTS 1438067 6/1976 United Kingdom .

OTHER PUBLICATIONS

Dyeing and Finishing Nomex® Type 450 Aramid (Bulletin NX-9, Mar., 1978).

*Primary Examiner*—A. Lionel Clingman

[57] ABSTRACT

A diamine salt and a surfactant are imbibed into never-dried aromatic polyamide fibers which may be printed or overprinted with acid dyes, after drying.

10 Claims, No Drawings

AROMATIC POLYAMIDE FIBERS AND METHOD OF PRINTING SUCH FIBERS WITH ACID DYES IN THE PRESENCE OF HEXAMETHYLENE DIAMINE DIHYDROCHLORIDE IMPREGNATED IN FIBER

BACKGROUND OF THE INVENTION

1. Field of the Invention

The field of art to which this invention pertains is aromatic polyamide fibers and, more particularly, it is directed to a method of printing or overprinting such fibers.

More specifically, in the method of this invention, a diamine salt is imbibed into a fiber structure or tow of never-dried Poly(meta-phenylene isophthalamide) fibers or filaments to provide dye sites for acid dyes after the fibers are dried. The diamine salt, along with a surfactant and, optionally, an ultraviolet light screener and an acid dye are formed into an aqueous mixture and padded out the fibers prior to simultaneous inhibition into the fibers. After drying, the fibers may be printed with acid dyes, without requiring the use of carriers or swelling agents, using conventional printing or overprinting techniques. The diamine salt and surfactant provide effective dye sites for the acid dyes. The overprinted fibers have improved dye shade and more shade depth than do known similar fibers.

2. Description of the Related Art

Aromatic polyamide fibers are known to the art. They have high tensile strength, are flame and heat resistant, possess good flex life, and have high melting points which make them particularly suited to be formed into fabrics usable as protective clothing, and for many other uses.

It further is known that while such aromatic polyamide fibers possess many desired properties as manufactured they also require, for given uses, that various steps be taken to improve a property or properties of the fibers to meet a specific end use. As an example, various additives such as dyes, ultraviolet light screeners, flame retardants, antistatic agents or water repellents, may be incorporated into the fibers during manufacture or such fibers may be treated in subsequent processing steps to improve their performance or appearance levels.

This invention is specifically directed to an improved method of printing or overprinting aromatic polyamide fibers of a poly(meta-phenylene isophthalamide) polymer, hereinafter referred to as "MPD-I fibers". Such fibers, which are described in greater detail in U.S. Pat. No. 3,287,324 to Sweeny, for example, possess many useful properties. It is well known to the art, however, that these fibers are difficult to dye or to print or overprint, using conventional techniques. It further is known that such fibers have little affinity for acid dyes. For this reason water-soluble cationic dyes are generally used exclusively to dye or print these materials.

In certain uses, however, such cationic dyes are unacceptable. As an example, when fabrics made from these fibers are overprinted for military camouflage purposes only certain water-soluble acid dyes, which have an acceptable infrared reflectance, can be used.

Various other problems associated with dyeing or coloring or printing MPD-I fibers, and proffered solutions to these problems, can be seen in U.S. Pat. No. 4,883,496 to Ghorashi and British patent 1,438,067 to Moulds and Vance, the teachings of which are incorporated herein by reference.

The limitations on the type of dye which may be used to dye MPD-I fibers have also been addressed by the art. For example, U.S. Pat. Nos. 3,558,267 to langenfeld; 4,525,168 to Kelly and 4,710,200 to Cates et al. disclose that almost any conventional dyestuff can be used to dye MPD-1 fibers, including acid dyes, by making a solution of the dye in a liquid which is a solvent or strong swelling agent for the fiber, or in a concentrated aqueous solution of the liquid, and heating the fiber in the resulting solution, or by incorporating a dye site substance into the fibers in the presence of a strong polar solvent, followed by the dyeing or printing operation. The problem with these approaches to coloring MPD-I fibers is that the fiber properties are usually adversely affected by the solvent or swelling agent. Also, recovery of the liquid remaining after dyeing or disposing of it in a non-polluting manner is a problem.

Accordingly, a method has long been sought for printing or overprinting MPD-I fibers with acid dyes to obtain improved coloration while retaining good fiber properties. This invention provides such a method by simultaneously imbibing a specific diamine salt (e.g., hexamethylenediamine dihydrochloride), along with a surfactant, into never-dried MPD-I fibers. Preferably, an ultraviolet light screener is imbibed into the never-dried fibers at the same time, along with an acid dye which about 0.5 to 5 wt. % of a first acid dye prior to being overprinted with at least a second acid dye.

This invention, in another embodiment, further includes a camouflage material of aromatic polyamide fibers containing a surfactant, a dye and a diamine salt, such material being overprinted with at least one acid dye.

The aromatic polyamide fibers of this invention are preferably made by imbibing a diamine salt into never-dried aromatic polyamide fibers, using steam; drying the fibers; and thereafter printing such fibers with an acid dye.

The preferred diamine salt used in this method is hexamethylenediamine dihydrochloride and such method may further include the steps of simultaneously imbibing a surfactant and an ultraviolet light screener into never-dried aromatic polyamide fibers, along with an acid dye.

In this method the fibers contain from about 0.3 to 3 wt. % of the diamine salt after drying. Such fibers also contain from about 5 to 15 wt. % of the surfactant after drying and the surfactant preferably is cationic. The fibers also contain from about 1 to 6 wt. % of the ultraviolet light screener after drying.

Camouflage material may be made following the teaching of this invention by overprinting aromatic polyamide fibers including the steps of co-imbibing, in a single step, a cationic surfactant structure prop, diamine salt acid dye sites, an ultraviolet light screener and a first acid dye into never-dried aromatic polyamide fibers, using steam; drying the fibers; preparing a fabric using a conventional textile process; and thereafter overprinting such fabric with at least a second acid dye.

Lastly, this invention is a method of overprinting aromatic polyamide fibers including the steps of padding onto the surface of never-dried aromatic poly(m-phenylene isophthalamide) fibers an aqueous mixture including a cationic surfactant, a diamine salt, an ultraviolet light screener and a first acid dye heating the fibers with steam to imbibe these materials into the fibers; serves as background coloration in the fibers when dried, after which such fibers may be readily overprinted with additional acid dyes, using conventional rotary screen printing techniques.

The surfactant serves as a structure prop and also as an ionic binding site for the acid dyes during overprinting. Additional ionic dye sites are supplied by the diamine salt, which further improves shade depth in the overprinted material.

A number of advantages accrue from this method:

* The fibers already have a base or background color prior to overprinting. The eliminates the need to dye the fabric prior to printing or eliminates one color in the printing process.

* The fibers are substantive to acid dyes (the only dyes acceptable for some camouflage applications because of IR reflectance). Aramids have a substantivity for basic (cationic) dyes, but not acid dyes.

* There is no need for carriers or solvents to swell the aramid structure to allow dye penetration. This can prove to be a difficult, and time-consuming, step when incorporating a dye or a dye site substance into aramid fibers which have been previously dried during processing.

* A high temperature roll heating step is not required to remove solvents used in the dyeing process.

* A U.V. screener can be included in the fibers, without any additional steps, to improve lightfastness.

* A conventional rotary screen printing process may be used to print the fibers, or fabric made from such fibers.

SUMMARY OF THE INVENTION

Briefly described, this invention is directed to or involves aromatic polyamine fibers adapted to be printed or overprinted with an acid dye. The fibers contain a diamine salt and a surfactant and, optionally, further contain an ultraviolet light screener and a background acid dye.

The preferred diamine salt is hexamethylenediamine dihydrochloride and the fibers should contain from about 0.3 to 3 wt. % of such salt. The fibers also preferably contain from about 5 to 15 wt. % of the surfactant which preferably is cationic. Such fibers further contain from about 1 to 6 wt. % of the ultraviolet light screener and from drying the fibers; and thereafter overprinting such fibers in fabric form with at least a second acid dye.

Again, the diamine salt is preferably hexamethylenediamine dihydrochloride and the inhibition mixture may include a mixture of acid dyes which are imbibed into the fibers prior to drying. The colored fabric formed from these dried fibers is overprinted with at least two acid dyes to form the remaining colors in the camouflage material.

DESCRIPTION OF THE PREFERRED EMBODIMENTS

This invention is a method of printing aromatic polyamide fibers with acid dyes.

More specifically, in the method of this invention, a diamine salt and a surfactant are imbibed into a fiber structure of never-dried poly(metaphenylene isophthalamide), MPD-I synthetic fibers to improve their printing or overprinting properties.

The never-dried, water-swollen MPD-I fibers into which the diamine salt and surfactant are imbibed may be prepared by the method described in U.S. Pat. No. 4,755,335 to Ghorashi. A suitable process for imbibing the materials into the fibers, using steam, is described in U.S. Pat. No. 4,919,869 to Zatkulak et al. The teachings of these patents are incorporated herein by reference.

The inhibition method just described takes full advantage of the properties of MPD-I fibers in their never-dried state. In this condition the open pores of fibers readily accept the imbibed materials without requiring the use of solvents or swelling agents. After drying this is not the case; the pores must be reopened to incorporate a material, such as a dye, into the fibers. And, even when this is done in the presence of a solvent or swelling agent, the operation is not as effective. Additionally, a harsh solvent or swelling agent can weaken the fiber structure.

More specifically, in the method of this invention, the diamine salt and surfactant are imbibed into the never-dried MPD-I fibers in an amount sufficient to provide effective dye sites for acid dyes, which are printed or overprinted onto the fibers after they are dried. Preferably, to be effective, it has been found that the fibers when dried should contain from about 0.3 to 3 wt. % of the diamine salt (preferably hexamethylenediamine dihydrochloride) and, optionally, from 5 to 15 wt. % of a preferred cationic surfactant.

If desired, other materials, such as a U.V. screener and a background dye or coloring material may be imbibed into the never-dried fibers simultaneously with the diamine salt and surfactant. Effective amounts of these materials in the dried fibers include from about 0.5 to 5 wt. % of a first or background dye or dye mixture and from about 1 to 6 wt. % of the ultraviolet light screener to improve lightfastness of imbibed acid dye and the other acid dye or dyes printed onto the fibers after drying.

In a preferred embodiment of this invention, all four of the above-mentioned materials are padded onto the surface of the never-dried fibers and co-imbibed into the pores of such fibers using steam, heated at appropriate temperatures (from about 100 to 140° C.). After drying, these fibers have an appropriate base or background color and are surprisingly and readily adapted to being overprinted, preferably in fabric form, with an acid dye or dyes to form camouflage material without the need for solvents or swelling agents, and using conventional printing techniques. As overprinted, such fibers have improved color and deep shade properties as the following examples will illustrate.

Example 1

Preparation of Never-Dried Filaments of Poly(m-phenylene isophthalamide) (MPD-I).

Filaments of MPD-I having an inherent viscosity of 1.5 were dry spun from a filtered solution containing 19% MPD-I, 70% dimethylacetamide (DMAc), 9% calcium chloride, and 2% water. On leaving the drying tower the as-spun filaments were given a preliminary wash with water so that they contained about 60% DMAc, 15% calcium chloride, and 100–150% water, based on the weight of dry polymer. The filaments were washed and drawn 4X at 90° C. in a counter-current extraction-draw process in which the calcium chloride determined as chloride content and DMAc content were reduced to about 0.1% and 0.5%, respectively. The wet filaments or fibers were gathered together to form a tow, a conventional antistatic finish was applied to the tow, and the tow was crimped in a stuffer box crimper at a temperature of about 80° C. in the presence of steam. The tow was then collected, still moist (containing from about 50%, plus or minus 20%, water based on the weight of the dry tow), in a plastic-lined cardboard box. The individual filaments had a linear density of about 1.9 decitex (1.7 dpf).

A. Inhibition of Cationic Surfactant (Acetate Salt), U.V. Screener, Diamine Salt, and Dyes into Never-Dried Filaments of MPD-I.

Two 120-kilotex (1,100,000 denier) tows of never-dried MPD-1 filaments, prepared as described above, were creeled through the guides of a continuous tow dyeing range equipped for exposing the tow to steam at chosen temperatures for selected exposure times, using the apparatus shown in U.S. Pat. No. 4,919,869 to Zatkulak et al. The tow was first fed between nip rolls at a rate of 20 m/min under a pressure of 203 kPa (two atmospheres), wherein an aqueous mixture was padded onto the tow. The aqueous mixture was prepared by adding 1550 g of isopropanol to 5400 g of a cationic surfactant comprising an imidazol acetate salt (commercially available as "Witcamine PA-60B" from Witco Corp., 520 Madison Ave., New York, N.Y.) and adding 2000g of a water soluble ultraviolet (u.v.) light screener having a benzotriazole structure with an attached polyethyleneoxide chain (commercially available as "Tinuvin 213"from Ciba Geigy Corp., Basel, Switzerland) to the resulting solution. A quantity of 569 g of a mixture of acid dyes was then added and the aqueous mixture was agitated until all of the dyes were completely dispersed. The mixture contained red, orange, and blue acid dyes which, blended together, imparted a light green color to the tow. The approximate concentration of the red, orange, and blue dyes, based on fiber weight, was 0.14, 0.63, and 0.66 wt. %, respectively ("Nylanthrene Red BNG", "Nylanthrene Orange BGN", and "Nylanthrene Blue BGA", respectively, available from Crompton & Knowles Corp., 345-T Park Avenue, N.Y., N.Y. 10154). A quantity of 10,270 g of a 30.5 % aqueous solution of a diamine salt, hexamethylenediamine dihydrochloride, was then added to the mixture with continuous agitation. The pick-up of the aqueous mixture on the tow was about 50 wt. %, based on the dry weight of the tow. The tows were then packed into the rectangular shaped steam chamber and carried through the chamber by a chain moving at about 1 m/min, one tow on each side of the chain. In the tow dyeing range, the tow was exposed to steam at 120° C. for seven to ten minutes. Upon exiting the tow dyeing range the tow was washed with water in a single wash step to remove materials which were not imbibed into it. A considerable portion of the diamine salt was washed out in this step. The tow was then fed into a forced air dryer with circulating air temperatures of 100° to 140° C. The dry tow was then cut to staple fibers with a 5-cm (2-in) cut length. The resulting staple fibers were spun into yarns and woven into fabric in conventional manner. The fabric was printed separately in three passes with two mixtures of acid dyes and a black pigment mixture in a camouflage overprint pattern in a conventional textile rotary screen printing press. One acid dye mixture had a dark green color and was formulated from C.I. Acid Yellow 169, C.I. Acid Blue 258, and C.I. Acid Blue 171. The other acid dye mixture had a brown color and was formulated from C.I. Acid Red 361, C.I. Acid Orange 156, and an acid blue dye ("Tectilon Blue 6G", commercially available from Ciba Geigy Corp., Basel, Switzerland).

In the accompanying Table the amounts of surfactant, diamine salt (hexamethylenediamine dihydrochloride salt), and u.v. light screener imbibed in the tow are shown ("Ex. 1A"). In the Table the percentages of the quantities imbibed are reported on the basis of the dry weight of the tow and were determined by analysis of the tow. The depth of the shade of the colors printed onto the fabrics were determined by knitting spun yarns made from the staple fibers cut from the dry tow into a tubing. Samples of the tubing were printed separately with each of the two acid dyes used to print the camouflage pattern in the woven fabric. A colorimeter (Hunter Colorimeter, available commercially from Hunter Associates Laboratory, Inc., 11405 Sunset Hills Rd., Reston, Virginia) was used to measure the color and shade depth (L Value) of both the light green background shade and the printed shade. The numbers reported in the Table are the difference between the light green background shade and the printed shade. The larger the number, the better (darker) the shade depth.

B. Double Washing of Steam-Treated Tow of Ex. 1A

The procedure of Part A above was repeated, except that the tow exiting the tow dyeing range was subjected to a second washing step with water to remove any materials readily extractble with water which still remained after the first washing step. The tow was then dried and cut to staple fibers; the resulting staple fibers were spun into yarns and woven into fabric; and the fabric was printed separately in three passes with two mixtures of acid dyes and a black pigment mixture in a camouflage overprint pattern, repeating the same procedure used in Part A. The results are shown in the Table ("Ex. 1B").

Example 2

A. Inhibition of Cationic Surfactant (Chloride Salt), U.V. Screener, Diamine Salt, and Dyes into Never-Dried Filaments of MPD-I.

The procedure of Example 1, Part A above was repeated, except that 7150 g of a solution of 70% of a cationic surfactant comprising an imidazoline chloride salt, 20% water, and 10% isopropanol (the solution being commercially available as "Witcamine 4137" from Witco Corp.) is substituted for the imidazoline acetate salt surfactant. All other materials, quantities, and procedures are the same as in Ex. 1, Part A, including a single wash step when the tow exited the tow dyeing range. The results achieved are shown in the Table ("Ex. 2A").

B. Double Washing of Steam-Treated Tow of Ex. 2A.

The procedure of Example 2, Part A above was repeated, except that the tow exiting the tow dyeing range was subjected to a second washing step with water to remove any materials readily extractable with water which still remained after the first washing step. The tow was then dried and cut to staple fibers; the resulting staple fibers were spun into yarns and woven into fabric; and the fabric was printed separately in three passes with two mixtures of acid dyes and a black pigment mixture in a camouflage overprint pattern, repeating the same procedure used in Part A. The results are shown in the Table ("Ex. 2B").

Control Example

A. Inhibition of Cationic Surfactant (Chloride Salt), U.V. Screener, and Dyes into Never-Dried Filaments of MPD-I.

The procedure of Example 2, Part A above was repeated, except that no diamine salt was added. All other materials, quantities, and procedures are the same as in Ex. 2, Part A, including a single wash step when the tow exited the tow dyeing range. The results achieved are shown in the Table ("Control A").

B. Double Washing of Steam-Treated Tow of Control A.

The procedure of the Control Example, Part A above was repeated (no diamine salt added), except that the tow exiting the tow dyeing range was subjected to a second washing step with water to remove any materials readily extractable with water which still remained after the first washing step. The tow was then dried and cut to staple fibers; the resulting staple fibers were spun into yarns and woven into fabric; and the fabric was printed separately in three passes with two mixtures of acid dyes and a black pigment mixture in a camouflage overprint pattern, repeating the same procedure used in Part A. The results are shown in the Table ("Control B").

TABLE

| | Quantities Imbibed | | | Hunter L Value Decrease | |
|---|---|---|---|---|---|
| | Surfactant | Diamine Salt | u.v. light screener | Green | Brown |
| Ex. 1A | 7.8% | 1.0% | 3.9% | 8.33 | 12.94 |
| Ex. 1B | 6.7 | 0.4 | 3.4 | 7.70 | 11.65 |
| Ex. 2A | 8.8 | 1.4 | 3.4 | 9.98 | 11.78 |
| Ex. 2B | 9.5 | 0.7 | 3.4 | 8.06 | 11.64 |
| Control A | 9.8 | 0.0 | 3.2 | 7.12 | 9.98 |
| Control B | 9.6 | 0.0 | 2.9 | 8.03 | 9.76 |

We claim:

1. Poly(meta-phenylene isophthalamide) fibers adapted to be printed with an acid dye and containing an acid dye, a diamine salt and a surfactant,
   wherein the diamine salt is hexamethylenediamine dihydrochloride and wherein such fibers contain from about 0.3 to 3 wt. % of such diamine salt, and
   wherein such fibers contain from about 5 to 15 wt. % of the surfactant and wherein such surfactant is cationic.

2. Poly(meta-phenylene isophthalamide) fibers adapted to be overprinted with acid dyes and containing a surfactant, a dye, a diamine salt and an ultraviolet light screener,
   wherein the diamine salt is hexamethylenediamine dihydrochloride and wherein such fibers contain at least 0.3 to 3 wt. % of the diamine salt,
   wherein such fibers contain from about 5 to 15 wt. % of the surfactant and wherein such surfactant is cationic,
   wherein such fibers contain from about 1 to 5 wt. % of the ultraviolet screener, and
   wherein such fibers contain from about 0.5 to 5 wt. % of a first acid dye prior to being overprinted with at least a second acid dye.

3. Poly(meta-phenylene isophthalamide) fibers containing a cationic surfactant, an acid dye and a hexamethylenediamine dihydrochloride diamine salt, such fibers being overprinted with at least another acid dye.

4. A method of printing poly(meta-phenylene isophthalamide) fibers including the steps of imbibing a diamine salt, a cationic surfactant and an acid dye into the never-dried fibers, using steam; drying the fibers; and thereafter printing such dried fibers with another acid dye and wherein the diamine salt is hexamethylenediamine dihydrochloride.

5. A method of printing poly-(meta-phenylene isophthalamide) fibers including the steps of simultaneously imbibing a surfactant, a diamine salt, an acid dye, and an ultraviolet light screener into never-dried aromatic polyamide fibers, using steam; drying the fibers; and thereafter printing such fibers with another acid dye,
   wherein the diamine salt is hexamethylenediamine dihydrochloride and wherein such fibers contain from about 0.3 to 3 wt. % of such diamine salt after drying,
   wherein such fibers contain from about 5 to 15 wt. % of the surfactant after drying and wherein such surfactant is cationic and
   wherein such fibers contain from about 1 to 6 wt. % of the ultraviolet screener after drying.

6. A method of overprinting poly(meta-phenylene isophthalamide) fibers including the steps of combibing, in a single step, a cationic surfactant, diamine salt, an ultraviolet light screener and a first acid dye into never-dried aromatic polyamide fibers, using steam; drying the fibers; and thereafter overprinting such fibers with at least a second acid dye and wherein the diamine salt is hexamethylenediamine dihydrochloride.

7. A method of overprinting aromatic polyamide fibers including the steps of
   padding onto the surface of never-dried aromatic poly(m-phenylene isophthalamide) fibers an aqueous mixture including
   a cationic surfactant, a diamine salt, an ultraviolet light screener and a first acid dye
   heating the fibers with steam to imbibe these materials into the fibers;
   drying the fibers; and
   thereafter overprinting such fibers with at least a second acid dye, and wherein the diamine salt is hexamethylenediamine dihydrochloride.

8. The method of claim 7 wherein such aqueous mixture includes a mixture of acid dyes which -are imbibed into the fibers prior to drying.

9. The method of claim 8 wherein such fibers are over-printed with at least two acid dyes after drying.

10. The method of claim 8 wherein the dried fibers are formed into fabric having a background color due to the presence of the imbibed acid dye and wherein such fabric is overprinted with at least two acid dyes to form the other colors of a camouflage material.

* * * * *